US009603455B2

(12) United States Patent
Mezzera

(10) Patent No.: US 9,603,455 B2
(45) Date of Patent: Mar. 28, 2017

(54) LAYERED CUSHION SEAT FOR A CHAIR

(71) Applicant: Marcelo Mezzera, Rancho Santa Margarita, CA (US)

(72) Inventor: Marcelo Mezzera, Rancho Santa Margarita, CA (US)

(73) Assignee: LF Centennial Limited, Tortola (VG)

( * ) Notice: Subject to any disclaimer, the term of this patent is extended or adjusted under 35 U.S.C. 154(b) by 0 days.

(21) Appl. No.: 15/234,391

(22) Filed: Aug. 11, 2016

(65) Prior Publication Data

US 2017/0035203 A1 Feb. 9, 2017

Related U.S. Application Data

(63) Continuation of application No. 14/808,262, filed on Jul. 24, 2015, now Pat. No. 9,414,682.

(51) Int. Cl.
*A47C 7/34* (2006.01)
*A47C 7/14* (2006.01)
*A47C 7/18* (2006.01)

(52) U.S. Cl.
CPC ..... *A47C 7/34* (2013.01); *A47C 7/14* (2013.01); *A47C 7/18* (2013.01)

(58) Field of Classification Search
CPC .... A47C 7/35; A47C 7/34; A47C 7/18; A47C 3/00; A47C 7/14
USPC ..... 297/452.51, 452.5, 209, 214, 452.27, 297/452.49, 208, DIG. 1
See application file for complete search history.

(56) References Cited

U.S. PATENT DOCUMENTS 2,785,440 A * 3/1957 Toulmin, Jr. ..... A47C 7/34 249/134
3,084,980 A * 4/1963 Lawson ..... A47C 7/20 297/452.17
9,149,124 B1 * 10/2015 Savovic ..... A47C 7/24
2003/0009830 A1 * 1/2003 Giori ..... A47C 27/084 5/709
2015/0202541 A1 * 7/2015 Oh ..... A63H 33/04 446/85
2015/0351557 A1 * 12/2015 Allen ..... A47C 27/144 5/655.5

* cited by examiner

*Primary Examiner* — Milton Nelson, Jr.
(74) *Attorney, Agent, or Firm* — Morland C. Fischer

(57) ABSTRACT

A seat having particular application for a chair to enhance the comfort of one seated in the chair. A plurality of (e.g., foam) cushion layers laying one over the other are located at the top of the seat. One of the plurality of foam cushion layers is manufactured from a material having a memory which conforms to and temporarily retains the shape of the user. Located at the bottom of the seat below the plurality of cushion layers are a plurality of coil springs that stand upwardly against the cushion layers in side-by-side alignment with one another so that the back of the seat is firmer than the front. The plurality of cushion layers are arranged in a stack such that the density of the memory foam cushion layer is greater than the density of the other ones of the plurality of cushion layers.

10 Claims, 2 Drawing Sheets

LAYERED CUSHION SEAT FOR A CHAIR

CROSS REFERENCE TO RELATED APPLICATIONS

This application is a continuation of patent application Ser. No. 14/808,262 filed Jul. 24, 2015.

BACKGROUND OF THE INVENTION

1. Field of the Invention

This invention relates to a seat for a chair by which the comfort of one seated in the chair is enhanced. A plurality of different foam cushion layers including a dense memory foam layer are located at the top of the seat and a plurality of wire coil springs are located in an evacuated area at the bottom of the seat so that the seat is firmer at the rear and softer at the front.

2. Background Art

Cushioned seats containing foam or some other relatively soft and flexible material are well known for providing comfort to one seated in a chair of which the cushioned seat is a part. In particular, the conventional chair seat is typically uniformly packed with foam, or the like, to cushion the legs of the user. Some seating arrangements include springs which are compressed to absorb the force generated by the user's weight. What would therefore be desirable is an improved seat for a chair which combines the advantages of both a cushion foam material with a set of springs to maximize the user's comfort and provide a seat which is softer at the front so as not to impede the flow of blood through the user's legs.

SUMMARY OF THE INVENTION

In general terms, an improved seat is disclosed of the kind that would commonly be found on a chair for the home or office. The seat is provided with both cushion and force-absorbing means by which to enhance the comfort of one seated in the chair. More particularly, a plurality of different foam cushion layers are bonded together so as to lay one above the other at the top of the seat. An intermediate one of the plurality of cushion layers is manufactured from a dense memory foam material. The responsiveness of the seat to react to and rebound from the user's weight and size as well as the depth to which the user's legs will sink in the seat can be selectively controlled by changing one or more of the thickness, weight and density of the memory foam and/or other cushion layers. Some of the plurality of cushion layers at the top of the seat are divided into pairs of layer sections laid end-to-end one another to separate the front of the seat from the rear.

Located at the bottom of the seat below the plurality of cushion layers is a coil spring foundation including a plurality of upstanding wire coil springs aligned side-by-side one another. The coil springs are surrounded and maintained in their side-by-side alignment by a cushion enclosure manufactured from a relatively hard foam material. The force of the weight of the user seated in the chair is transmitted to and absorbed by the plurality of coil springs of the coil spring foundation located at the bottom of the seat by way of the plurality of cushion layers located above the coil springs at the top of the seat. Most of the springs are located below the rear of the seat so that the front will be softer than the rear so as not to slow the circulation of blood through the user's thighs being supported by the front.

DESCRIPTION OF THE PREFERRED EMBODIMENT

Figure 1:
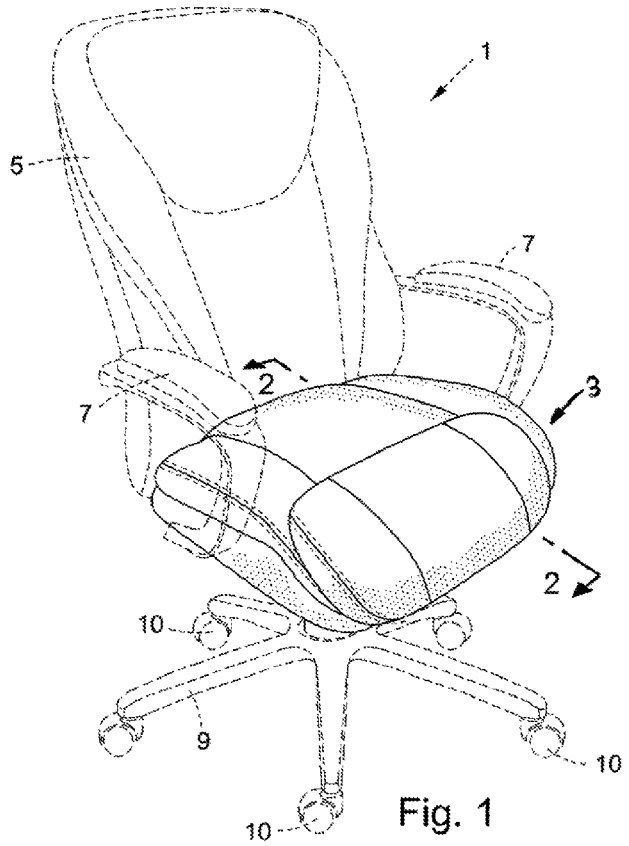
FIG. 1 shows an improved layered cushion seat which forms the present invention and one example of a chair with which the seat is associated to enhance the comfort of one seated in the chair.
Figure 2:
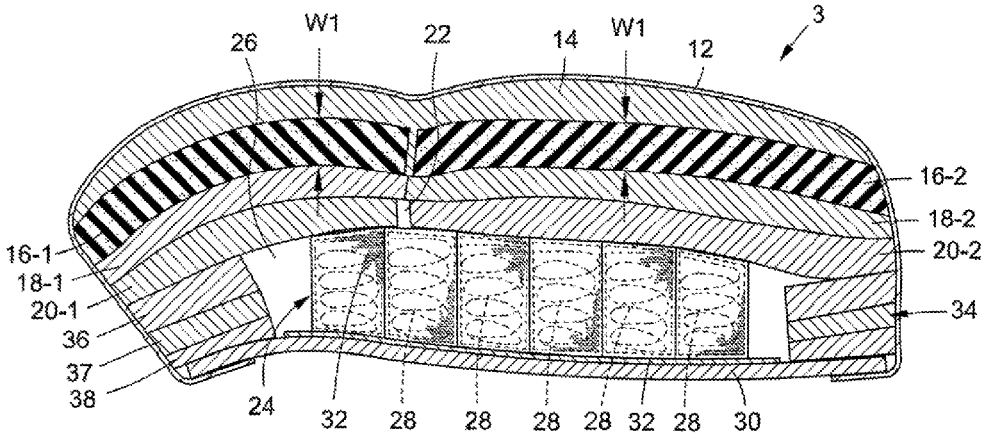
FIG. 2 is a cross-section of the layered cushion seat taken along lines 2-2 of FIG. 1 to show details of the seat according to a first preferred embodiment.

A chair 1 having an improved layered cushion seat 3 to enhance the comfort of one seated on the chair is disclosed while referring initially to FIGS. 1 and 2 of the drawings. The chair 1 shown in FIG. 1 is typically the kind that would be found in an office. In this regard, the chair 1 has the aforementioned layered cushion seat 3 upon which to support the weight of a user. An upright back 5 stands generally vertically from the seat 3 to support the user's back thereagainst. A pair of arms 7 are shown connected between the back 5 and the seat 3 of the chair 1 upon which the user can rest his arms while seated. A base 9 extends from below the seat 3 to the floor. The chair base 9 has a set of rollers 10 to permit the chair 1 to be rolled from place-to-place over the floor.

However, it is to be understood that the particular chair of which the improved layered cushion seat 3 is a part is not limited to the office chair shown in FIG. 1, such that the chair can have different configurations for a variety of applications in an office, at home and elsewhere. In this same regard, the particular back 5, arms 7, and base 9 (all of which being shown in phantom lines) of the chair 1 with which the seat 3 is associated play no role in the present invention. Moreover, a set of straight legs can be substituted for the base 9 and the set of rollers 10.

In accordance with a first preferred embodiment of this invention, and referring specifically to FIG. 2, there is shown a cross-section of the improved layered cushion seat 3. As will be described in greater detail hereinafter, the enhanced comfort provided by the seat 3 is achieved by means of a plurality of cushioned (e.g., foam) layers having different characteristics disposed one above the other and supported upon a coil spring foundation 24.

More particularly, the layered cushion seat 3 is surrounded by a cover 12 that is manufactured from a wear-resistant and aesthetically-pleasing material, such as bonded leather, or the like. Lying below the cover 12 is a continuous first cushion layer 14. Cushion layer 14 is preferably manufactured from a poly-foam material containing polyester fibers. The first cushion layer 14 has an ideal thickness of about 5.0 cm and a weight of 0.2 kg.

Lying below the first cushion layer 14 of the layered cushion seat 3 is a second cushion layer. The second cushion layer is divided into a pair of layer sections 16-1 and 16-2 laying end-to-end one another. The forward-most layer section 16-1 is located at the front of the seat 3 to support the weight of the user's thighs. The rear-most layer section 16-2 is located at the back of the seat 3 to support the weight of the user's pelvis. Each of the layer sections 16-1 and 16-2 of the second cushion layer is manufactured from a material having a memory that conforms to and temporarily retains the shape of the user. That is, the memory material from which the layer sections 16-1 and 16-2 is manufactured is adapted to respond to the user's weight by first being compressed and, after temporarily conforming to the shape of the user's pelvis and thighs for a time after the user has left the seat, rebounds (i.e., expands) back to its original shape. One such suitable memory material is a heavy and dense polyurethane foam that is slow to respond to the user's weight and size and slow to recover to its original shape relative to the other cushion layers of the layered cushion seat 3. The second cushion layer including memory sections 16-1 and 16-2 has an ideal thickness (designated W1) of 4.0 cm, a weight of 0.4 kg, and a density of 60.

Lying below the second (memory foam) cushion layer sections 16-1 and 16-2 of the layered cushion seat 3 is a third cushion layer. Like the second cushion layer, the third cushion layer is divided into a pair of layer sections 18-1 and 18-2 laying end-to-end one another. The forward-most layer section 18-1 is located at the front of the seat 3 lo support the user's thighs, and the rear-most layer section 18-2 is located at the back of the seat 3 to support the user's pelvis. Each of the layer sections 18-1 and 18-2 of the third cushion layer is manufactured from a normal (i.e., non-memory) foam material such as, for example, polyurethane. The third cushion layer including layer sections 18-1 and 18-2 has an ideal thickness of 2.0 cm, a density of 28, a weight of 0.1 kg and a hardness of 30.

Lying below the third cushion layer sections 18-1 and 18-2 of the layered cushion seat 3 is a fourth cushion layer. Like the second and third cushion layers, the fourth cushion layer is divided into a pair of layer sections 20-1 and 20-2 laying end-to-end one another and separated by an air gap 22. The forward-most layer section 20-1 is located at the front of the seat 3 to support the user's thighs, and the rear-most layer section 20-2 is located at the back of the seat 3 to support the user's pelvis. Each of the layer sections 20-1 and 20-2 of the fourth cushion layer is manufactured from a hard (relative to the third cushion layer) normal foam material such as, for example, polyurethane. The fourth cushion layer including layer sections 20-1 and 20-2 has an ideal thickness of 3.0 cm, a density of 28, a weight of 0.15 kg and a hardness of 70.

The first, second, third and fourth cushion layers 14, 16-1, 16-2, 18-1, 18-2, 20-1 and 20-2 are (e.g., adhesively) bonded together so as to lie one over the other and establish a composite cushion to cover the coil spring foundation 24. The coil spring foundation 24 includes a plurality of (e.g., thirty) wire coils 28 which stand side-by-side one another between the sections 20-1 and 20-2 of the fourth cushion layer and a plywood seat support panel 30 at the bottom of seat 3 to which the seat cover 12 is attached. The coil spring foundation 24 is seated on the seat support panel 30 within an evacuated area 26 at the bottom of the layered cushion seat 3. Each of the upstanding coils 28 is individually wrapped in a non-woven fabric 32. The coils 28 are conventional and are manufactured from a flexible material, such as steel and polypropylene fiber. A fabric layer 32 runs between the coil springs 28 of the coil spring foundation 24 and the seat support panel 30 to reduce noise when the coil springs are being compressed and expanded as the user enters and leaves the chair 1.

The evacuated area 26 within the layered cushion seat 3 in which the coil spring foundation 24 is located is surrounded by a cushion enclosure 34 which keeps the coil springs standing upright and preserves their side-by-side alignment. The cushion enclosure 34 includes a stack of three identical cushion layers 36, 37 and 38 bonded together and lying one above the other. The coil spring foundation 24 is positioned in the evacuated area 26 at openings formed through the centers of the stacked layers 36-38 prior to the first, second, third and fourth cushion layers being seated on the coil spring foundation 24. Each cushion layer 36-38 of the stack is ideally manufactured from a (e.g., polyurethane) foam material, such that the cushion enclosure 34 has a thickness of about 6.0 cm, a density of 24, a weight of 0.25 kg, and a hardness of 70. Rather than the individual cushion layers 36-38, the cushion enclosure 34 can also be a single continuous layer having an opening at the center thereof that is dimensioned for receipt of the coil spring foundation 24.

The stack of cushion layers 14, 16-1, 16-2, 18-1, 18-2, 20-1 and 20-2 at the top of the layered cushion seat 3 are attached (e.g., adhesively bonded) over top the coil spring foundation 24 and the cushion enclosure 34 which surrounds foundation 24. Thus, the force generated by the weight of the user sitting in the seat 3 is transmitted to and absorbed by the coil springs 28 by way of the plurality of cushion layers. The hardness of the seat 3 increases from the top of the seat towards the coil spring foundation 24 at the bottom. Moreover, the divided sections 16-1, 16-2 and 18-1, 18-2 and 20-1 and 20-2 of the second, third and fourth cushion layers as well as the air gap 22 between sections 20-1 and 20-2 of the fourth cushion layer allows the front and back of the seat 3 to be separated so that the majority of the coils 28 from the coil spring foundation 24 lie below the cushion layers 16-2, 18-2 and 20-2 at the back of the seat. Thus, the back of the seat 3 will be firmer and the front of the seat will be softer so as to advantageously avoid slowing the circulation of blood flow through the user's thighs which are supported by the front.

In the case of the layered cushion seat 3 shown in FIG. 2, the adjacent memory foam sections 16-1 and 16-2 of the second cushion layer lie between the first and third cushion layers and extend continuously across the seat. The thickness, density and weight of the memory foam sections 16-1 and 16-2 of the second cushion layer of the seat 3 shown in FIG. 2 are at least equal to or greater than that of the foam sections 18-1, 18-2 and 20-1, 20-2 of the third and fourth cushion layers. Adjusting the thickness, density and weight of the memory foam sections 16-1 and 16-2 correspondingly controls the ability of the seat 3 to react (i.e., sink down) in response to the user's weight when he sits in the chair 1 and later rebound after the user has left the chair. What is more, the addition of the memory foam sections 16-1 and 16-2 sandwiched between the normal foam layers lying above and below results in a more comfortable cushion effect for the user.

Figure 3:
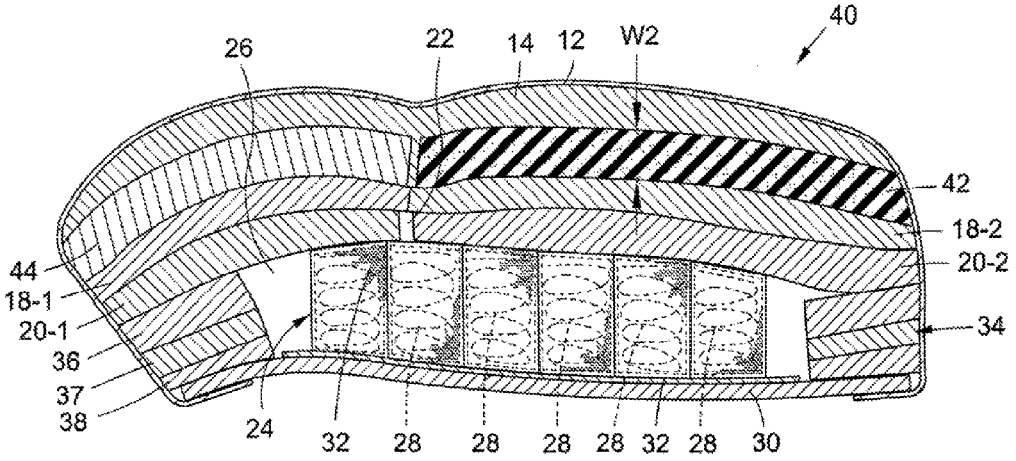
FIG. 3 is a cross-section of the layered comfort seat to show details thereof according to another preferred embodiment.

A layered cushion seat 40 according to an alternate preferred embodiment of this invention is described while referring to FIG. 3 of the drawings. The layered cushion seat 40 of FIG. 3 can be substituted for the seat 3 shown in FIG. 2 and associated with the chair 1 of FIG. I. Identical reference numerals are used to designate identical features from the layered cushion seats 3 and 40. The features of the seat 40 of FIG. 3 that are common to the seat 3 of FIG. 2 will not be described again.

The previously described layered cushion seat 3 of FIG. 2 has a foam cushion layer which includes a pair of memory foam sections 16-1 and 16-2 laid end-to-end one another and sandwiched between a plurality of normal foam cushion layers. In the case of the layered cushion seat 40 of FIG. 3, a single cushion layer section 42 manufactured from a memory material (e.g., a heavy, dense polyurethane foam) is laid at the back of the seat adjacent a normal foam cushion layer section 44 at the front that is manufactured from a less dense and lighter polyurethane foam. Therefore, the back of the seat 40 is heavier than the front. The density (e.g., 60) of the memory foam section 42 of the seat 40 is the same as the density of the memory foam sections 16-1 and 16-2 from the earlier-described seat 3. However, as an example of being able to control the reaction of the seat 40 to respond to the user's weight, the memory foam section 42 thereof has an ideal thickness (designated W2) of 3.0 cm and a weight (e.g., 0.15 kg) that are thinner and lighter than the thickness and weight of the memory foam sections 16-1 and 16-2 of the seat 3.

The adjacent memory foam and normal foam sections 42 and 44 at the back and front of the layered cushion seat 40 are sandwiched (i.e., bonded) between a first cushion layer 14 and third and fourth cushion layers including end-to-end foam sections 18-1, 18-2 and 20-1, 20-3. The first, third and fourth cushion layers 14, 18 and 20 of the layered cushion seat 40 may be identical to the cushion layers having the same reference numerals from the seat 3 of FIG. 2. However, by manufacturing the second layer of the layered cushion seat 40 of FIG. 3 with thinner and lighter adjacent memory and normal foam sections 42 and 44 when compared with the adjacent memory foam sections 16-1 and 16-2 of the seat 3, the ability of the seat 40 to sink and to respond to the user's weight can be adjusted depending upon whether the user moves forward or leans back in the seat 40. That is, the user's weight is applied to either the memory foam section 42 at the relatively heavy and stiff back of the seat or to the adjacent normal foam section 44 at the lighter and softer front where a more cushioned effect will be experienced that will not interfere with blood flow through the user's legs.

Figure 4:
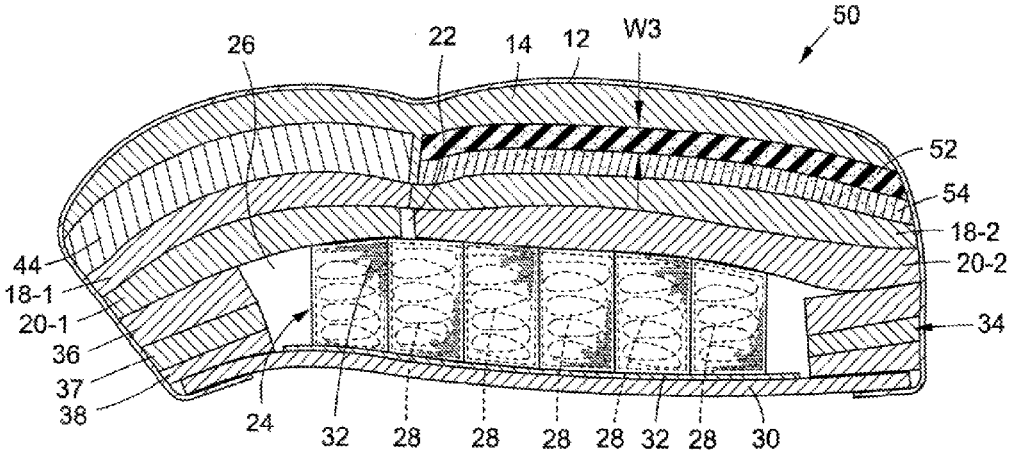
FIG. 4 is a cross-section of the layered cushion seat to show details thereof according to a different preferred embodiment.

A layered cushion seat 50 according to another preferred embodiment of this invention is described while referring to FIG. 4 of the drawings. The layered cushion seat 50 of FIG. 4 can be substituted on the chair 1 of FIG. 1 for either one of the seat 3 of FIG. 2 or the seat 40 of FIG. 3. Identical reference numerals are used to designated identical features of the layered cushion seats 3, 40 and 50 of FIGS. 2-4, and the features of seat 50 that are common to those of the seats 3 and 40 will not be described again.

The second cushion layer of the seat 40 that was previously described while referring to FIG. 3 has a memory foam section 42 located at the back of the seat which lays end-to-end an adjacent normal foam section 44 at the rear of the seat. In the case of the seat 50 shown in FIG. 4, the memory foam section 42 of FIG. 3, is replaced by a thinner and lighter memory foam section 52 at the back of seat 50. In particular, the memory foam section 52 has an ideal thickness (designated W3) of 2.0 cm and a weight of 0.1 kg. The ideal density of memory foam section 52 (e.g., 60) is the same as that of the memory foam sections 16-1, 16-2 and 42 from the seats 3 and 40 shown in FIGS. 2 and 3.

Because the memory foam section 52 has a relatively narrow thickness, it is laid over and bonded to a relatively thin normal foam filler section 54. In this case, the memory foam section 52 and the normal foam filler section 54 lay one on top of the other at the back of the seat 50 adjacent the opposing normal foam section 44 lying at the front of the seat. However, the memory foam section 52 of the seat 50 is thinner than its adjacent normal foam section 44.

FIG. 4 provides another example of a layered cushion seat 50 where the ability to selectively control the reaction of the seat to sink in response to the user's weight and then rebound to its original shape is dependent upon the thickness, density and weight of the memory foam section 52. In this regard, it can be appreciated that the respective thicknesses (designated W1, W2 and W3) and the weight of the memory foam layers 16-1, 16-2 and 42 and 52 of the seats 3, 40 and 50 of FIGS. 2-4 are reduced from one seat to the next to speed up the seat's reaction. Moreover, the density (e.g., 60) of the memory foam layers of the seats 3, 40 and 50 is greater than the density of the other normal foam layers between which the memory foam layers are sandwiched. According to a preferred embodiment, the density of the memory foam layer 16-1, 16-2 and 42 and 52 of each seat is at least twice the density of the normal foam layer sections of the seat. Also according to a preferred embodiment, the weight of the memory foam layer 16-1, 16-2 and 42 and 52 of each seat is greater than or equal to the weight of the normal foam layer sections.

The invention claimed is:

1. A seat for a chair, said seat having a top, a bottom, a front at which to support, a user's thighs, and a back at which to support the user's pelvis and comprising a plurality of cushion layers located at the top of said seat, said plurality of cushion layers laying one on top of the other; and a plurality of springs located at the bottom of said seat below said plurality of cushion layers such that a force that is created when a user is seated on the seat is transmitted to and absorbed by said plurality of springs by way of said plurality of cushion layers, and wherein a majority of said plurality of springs is positioned relative to said plurality of cushion layers, such that the back of said seat is firmer than the front.

2. The seat recited in claim 1, wherein at least one of said plurality of cushion layers is manufactured from foam.

3. The seat recited in claim 2, wherein the at least one of said plurality of cushion layers is manufactured from a foam material having a memory such that said one cushion layer responds to the user when sitting on the seat by the shape of said one cushion layer first being compressed and temporarily conforming to the shape of the user for a time after the user leaves the seat and then rebounding to its original shape.

4. The seat recited in claim , wherein the weight of the foam memory material from which the at least one of said plurality of cushion layers is manufactured is greater than or equal to the weight of the material from which the other ones of said plurality of cushion layers are manufactured.

5. The seat recited in claim 3, wherein the density of the foam memory material from which the at least one of said plurality of cushion layers is manufactured is greater than the density of the material from which the other ones of said plurality of cushion layers are manufactured.

6. The seat recited in claim 5, wherein the density of the foam memory material from which the at least one of said plurality of cushion layers is manufactured is at least twice the density of the material from which the other ones of said plurality of cushion layers are manufactured.

7. The seat recited in claim 1, wherein said plurality of springs are coil springs standing upwardly against said plurality of cushion layers and being aligned side-by-side one another below said plurality of cushion layers.

8. The seat recited in claim 7, further comprising a cushion enclosure located at the bottom of said seat and surrounding said plurality of upstanding coil springs to hold said plurality of upstanding coil springs in their side-by-side alignment relative to one another below said plurality of foam cushion layers.

9. The seat recited in claim 1, wherein at least one of said plurality of cushion layers is divided into first and second cushion layer sections laying end-to-end one another, said first cushion layer section located at the front of said seat and laying over a minority of said plurality of springs, and said second cushion layer located at the back of said seat and laying over the majority of said plurality of springs.

10. The seat recited in claim 9, wherein there is an air gap located between the first and second cushion layer sections of the one of said plurality of cushion layers.

* * * * *